US008225585B2

(12) United States Patent
Bohler

(10) Patent No.: US 8,225,585 B2
(45) Date of Patent: Jul. 24, 2012

(54) DOSAGE-DISPENSING DEVICE

(75) Inventor: Lorenz Bohler, Möhlin (CH)

(73) Assignee: Mettler-Toledo AG, Greifensee (CH)

( * ) Notice: Subject to any disclaimer, the term of this patent is extended or adjusted under 35 U.S.C. 154(b) by 350 days.

(21) Appl. No.: 12/629,487

(22) Filed: Dec. 2, 2009

(65) Prior Publication Data

US 2010/0147882 A1 Jun. 17, 2010

(30) Foreign Application Priority Data

Dec. 17, 2008 (EP) ..... 08172005

(51) Int. Cl.
*B65B 1/02* (2006.01)

(52) U.S. Cl. ..... 53/551; 53/450; 53/436; 53/550

(58) Field of Classification Search ..... 53/450–452, 53/436, 523, 527, 528, 550, 551, 555
See application file for complete search history.

(56) References Cited

U.S. PATENT DOCUMENTS 3,440,696 A 4/1969 Staller
3,849,965 A * 11/1974 Dominici ..... 53/451
4,884,387 A * 12/1989 James ..... 53/451
4,958,477 A * 9/1990 Winkler ..... 53/138.3
5,713,186 A * 2/1998 Bruhn ..... 53/450
5,944,070 A 8/1999 Schmidt et al.
6,289,654 B1 * 9/2001 Yamaguchi et al. ..... 53/434
7,104,293 B2 9/2006 Lais et al.
7,458,195 B2 * 12/2008 Bezek et al. ..... 53/445
2007/0251599 A1 11/2007 Denk et al.
2010/0215813 A1 * 8/2010 Peterson et al. ..... 426/106

FOREIGN PATENT DOCUMENTS

WO 2008/017173 A2 2/2008
WO 2008/017175 A1 2/2008

* cited by examiner

*Primary Examiner* — Hemant M Desai
(74) *Attorney, Agent, or Firm* — Standley Law Group LLP

(57) ABSTRACT

A device for dispensing a dosage material has a container with an outlet spout and a metering element adjoining the outlet spout. The metering element has an inlet opening on a side facing the container and an outlet opening on a side that faces away from the container. A wall of the metering element extends between the openings. A film material can be inserted into the device which passes at least through the inlet opening and the slot-shaped outlet opening and covers the inside of the wall. The device also has a feature that stretches a portion of a tube section of the film material. This stretching device includes at least two locations for fastening the portion to be stretched, the two locations being arranged on a stretch line that is at an angle to the lengthwise direction of the tube section.

18 Claims, 7 Drawing Sheets

DOSAGE-DISPENSING DEVICE

CROSS-REFERENCE TO RELATED APPLICATIONS

This application claims a right of priority under 35 USC §119 from European patent application 08 17 2005.4, filed 17 Dec. 2008, the content of which is incorporated by reference as if fully recited herein.

TECHNICAL FIELD

The disclosed embodiments relate to a dosage-dispensing device which is comprised of a dosage material container with an outlet spout and a metering element adjoining the outlet spout.

BACKGROUND OF THE ART

Dosage-dispensing devices find application in areas where in the course of one or more mixing- and/or treatment processes an end product is made out of a large number of different pulverous or granular ingredient materials. Examples which can be named for such processes include the chemical industry and also the pharmaceutical industry. While formulations at the development stage are mixed on a laboratory scale from minuscule quantities, the manufacture of the finished product consumes industrial-sized quantities of ingredient materials, because this is the only way to obtain a sufficient lot size and thus ensure an economical production. In particular in the pharmaceutical/chemical industry, the cleanliness of the instruments and utensils being used is of the foremost importance besides the purity of the ingredient products, because only through a strict quality management is it possible to maintain the quality standards which have meanwhile been established within a framework of certification systems in almost all branches of industry. In this environment, it is particularly important that the instruments involved are immediately after use subjected to an extremely stringent cleaning procedure, before the instruments can be put back into operation after they have undergone diverse cleanliness inspections and function checks. A particularly important aspect in the production of chemicals, particularly in the manufacture of pharmaceuticals, is the transfer of raw materials or intermediate products into intermediate holding-containers and/or mixing containers and, at the end of the production process, into transport containers and storage containers.

As a means to dispense defined quantities of formulation components even in large amounts with the highest possible accuracy, one uses metering elements with variable outlet apertures. Such metering elements can be arranged between the containers or also inside of tube conduits, so that the product flow can be controlled manually or automatically in conformance with requirements on the precision and speed of the dosage-dispensing process.

The problem with using a metering element in this manner is that during the filling- or dispensing process at least the inside of the element is in permanent contact with the product to be dispensed. This has the consequence that either a special metering element has to be used for each different substance to be dispensed, as a way to extend the usage intervals as much as possible, or that especially in view of the aforementioned quality standards the metering element is put through the cleaning and checking procedure after each dosage-dispensing process in order to prevent cross-contamination between different substances.

Added to this is the problem that during a certain time interval after the dosage-dispensing process has been completed and the receiving container has been removed, the user of the filling device can come into contact with the dosage substance. This is the case for example if there are product residues left over in the metering element and/or if a pulverous product with a tendency to spread dust is being dispensed. The possibility can therefore not be ruled out that the user may become contaminated through contact with the skin, the mucous membranes or airways, whereby the user's health could be endangered.

As a means to eliminate the last-mentioned aspect or to reduce the risks as much as possible, an emptying device for bags with an inner and outer bag (i.e. so-called bulk bags) is proposed in U.S. Pat. No. 5,944,070 to Schmidt, which includes a holder device for bulk bags and, arranged in central alignment below the holder device, a double-tube device with an inner and an outer tube. The latter device has a gripper device arranged preferably in the inner tube and movable in the up and down direction, which serves to hold the bag outlet of the inner bag and which can be pulled from the up to the down position by means of a pulling device that is operable from the outside.

A device to empty and fill flexible bulk material containers without causing contamination is described in US published application 2007/0251,599 to Denk. It uses a tubular film as connecting member from a container that is being emptied to a connector tube or an inlet opening. After the filling or emptying process has been completed, this tubular film is tied off together with the flexible container and/or the filled container, whereupon the contaminated film is detached and discarded.

These devices have a variety of disadvantages. Although in all devices an unintended escape of the filling material is prevented as far as possible and the risk of contaminating the environment and the user is thus reduced to a large extent, the filling material is in contact with the filling devices and/or metering elements during the transfer or filling process in all of the proposed arrangements. After using these kinds of devices in sensitive areas it will therefore be necessary to clean and/or decontaminate the entire filling- or dosage-dispensing apparatus. An appropriate cleaning involves a large amount of time and expense and necessitates a series of inspection checks before the filling- or dosage-dispensing device can be put back into operation.

In the present inventor's commonly-owned published application WO2008/017175 (Bohler '175), which is hereby incorporated by reference in its entirety, a dosage-dispensing device is proposed by means of which these drawbacks can largely be avoided. This dosage-dispensing device has a container for dosage material with an outlet spout that reaches into a metering element. The metering element has an inlet opening on the side that faces the container, a clamping profile and/or a quick-tightening device to releasably connect the outlet spout and the metering element, a slot-shaped outlet opening on the side that faces away from the container, a ring gap between the outlet spout and the inlet opening, a wall with an inside and an outside extending between the inlet opening and the outlet opening, and a supply of film material that is stored in the area of the outlet spout, in particular a plastic film or an elastomeric film. As a container, it is possible to use a reservoir hopper to which the outlet spout is solidly connected, for example welded. However, in addition it is also possible to attach the metering element to a container in the shape of a funnel configured for example in such a way that bags can be inserted into its fill spout, or which can be positioned under the outlet openings of large silos. It is further intended that the inlet opening, the inside of the wall and the slot-shaped outlet opening are covered with the film material.

However, with the foregoing arrangement it is possible that during a dosage-dispensing process pocket-shaped folds or wrinkles may appear in the film material during a dosage-dispensing process and that dosage material could be caught in these wrinkles. This could have the result that the outlet opening of the metering element can no longer be closed satisfactorily and will leak if one of these pockets forms in the slot-shaped outlet opening. Furthermore, this could also cause the destruction of the film material so that the latter would no longer perform its protective function.

It is therefore an object to provide a dosage-dispensing device that belongs to the aforementioned kind but provides the highest level of functional reliability and the best possible safety in regard to the risk of contaminating the environment.

SUMMARY

This task is solved by a dosage-dispensing device with the characterizing features of the independent claims. Further preferred embodiments are set forth in the dependent claims.

The dosage-dispensing device includes a container for the dosage material with an outlet spout and a metering element adjoining the outlet spout. The term "container" covers all objects that are suitable to hold dosage material, for example tanks, silos, storage bunkers, funnels, tubes, bags, pipes, canisters, bowls, tubs, ducts and the like.

The metering element has an inlet opening on the side that faces towards the container, an outlet opening which is slot-shaped when in the closed condition and is located on the side that faces away from the container, and a wall with an inside and an outside which extends between the inlet opening and the outlet opening. Furthermore, a film material can be inserted into the dosage-dispensing device which passes at least through the inlet opening and the slot-shaped outlet opening and covers the inside of the wall. The inserted film material can already be configured as a tube. However, other designs are also feasible, where the film material is stored as a band that is wound on a roll and is pulled through at least the metering element in such a way that the film material forms a tubular section that extends at least from the inlet opening and through the outlet opening into the space below the outlet opening. Accordingly, during a dosage-dispensing process the dosage material is channeled through this tubular section which begins before or at the inlet opening, so that any contact between the metering element and the dosage material is prevented. With coarse-grained bulk materials, the film material does not even have to be welded together lengthwise into a tube. The protective function can also be achieved by means of a sufficient overlap of the border areas of the film.

The dosage-dispensing device includes a stretching device which serves to stretch a portion of the tube section. This stretching device includes at least a first fastening location and at least a second fastening location to fasten the aforementioned portion of the tube section. The two fastening locations are arranged on a stretch line that is arranged at an angle to the lengthwise direction of the tube section. The description "at an angle" means that the stretch line does not run parallel to the lengthwise direction of the tube section. Thus, the tube section can always be tensioned in a direction transverse to its length. Of course, there is a preferred range for the angle enclosed between the stretch line and the central lengthwise axis of the tube section. The preferred range of the enclosed angle is between 30° and 90°, with an angle of 90° corresponding to a horizontal orientation of the stretch line.

To make it possible for the tube section to be stretched, at least one of the fastening locations needs to be capable of linear displacement along the stretch line. To ensure that there are no wrinkles on the stretch line, the portion of the tube section is fastened at a cross-sectional perimeter to the first and second fastening locations in such a way that the cross-sectional perimeter is divided into two perimeter segments of essentially equal length. The cross-sectional perimeter is the perimeter of a cross-section of the tube section in a plane that contains the stretch line.

Preferably, the stretch line is arranged in a plane that contains the slot-shaped outlet opening and extends in the lengthwise direction of the tube section. This orientation of the stretch line in relation to the slot-shaped outlet opening contributes to minimizing the formation of wrinkles when the outlet opening is being closed.

In a preferred embodiment, it is envisioned that the stretch line is arranged parallel to the slot-shaped outlet opening and that the distance of the stretch line from the slot-shaped outlet opening is equal to or smaller than a maximally allowable distance that is defined by the material properties of the film material. The smaller the material thickness of the film material, the less stable is the film in regard to its stiffness. When the portion of the tube section is being stretched, a thin film will therefore form wrinkles at a closer distance from the stretch line than a thicker film. Logically, this same effect can also be observed with films that have different material properties.

The stretch line does not necessarily have to be arranged inside the metering element or outside the metering elements. It can also be arranged at an angle to the outlet opening which is slot-shaped in the closed condition or, more precisely, the stretch line can intersect the outlet opening. To make this possible, at least one of the fastening locations has to be arranged inside the metering element.

Preferably, however, the stretch line extends inside the outlet opening, with the first fastening location being arranged in the area of the first end and the second fastening location in the area of the second end of the slot-shaped outlet. This arrangement is the safest, as there are no creases expected to form in the stretch line.

The stretching device can be used in all dosage-dispensing devices with a metering element that has a slot-shaped outlet. This also includes the metering element disclosed in the present inventor's commonly-owned published application WO2008/017173 ("Bohler '173"), which includes an elastic material in which the slot-shaped outlet opening is formed.

Of course, the metering element does not necessarily have to be the metering element of the foregoing description. Any metering elements are suitable which have a slot-shaped outlet opening. Consequently, the metering element can also have at least one shutter slide or a shutter jaw. The shutter jaws can for example be configured for linear-guided movement or swivel movement. In exactly the same way, the stretching device can be used in conjunction with a coupling element that is used as a metering element as disclosed in U.S. Pat. No. 7,104,293 to Lais.

Preferably, the slot-shaped outlet opening is designed to run in a straight line. However, it can also be arc-shaped, if this appears to be more advantageous. In the latter case, care needs to be taken to select the radius of the arc so that in spite of the stretching of the film material wrinkles are still prevented from occurring in the area of the outlet opening when the latter is being closed.

The metering element disclosed in Bohler '173 offers even further advantages. For example, the fastening locations can be connected rigidly or elastically to the ends of the slot-shaped outlet, whereby the tube section can be stretched simultaneously with the closing of the outlet.

Furthermore, a metering element of this kind can also have fastening means encircling the area of the outlet, whereby the entire perimeter of the tube section can be fastened. Such a fastening means can, for example, consist of the ribbed connection that is disclosed in U.S. Pat. No. 3,440,696 to Staller. The groove part of this connection would be formed in the slot-shaped outlet opening, while the snap-closure rib would be formed on the film material. Of course, the fastening locations could also be clamping jaws, detent elements, hook- and loop fasteners or adhesive pads.

The film material for insertion into the dosage-dispensing device can have several different suitable configurations. The film material in the form in which it is being stored is a tube with a closed cross-section, i.e., it is configured as a continuous tube. As an additional possibility, the material could also be stored in the form of individual tube sections. Before the metering element is set in place, or before the dosage-dispensing process is started, the tube sections can be pushed over the outlet spout and pulled through the metering element, and a supply of tube section could thus be stored in the vicinity of the outlet spout of the container.

It is further possible to store the material as a continuous film tube which has perforations in defined places and is broken up into individual sections by tearing it off at the perforations. According to a further preferred embodiment, the film material is supplied as a continuous web of film which only at the time of use, i.e. when the film material is passed through a ring gap between the outlet spout and the inlet opening, is formed into a tube that is impermeable in the radial direction. The step of forming a tube out of the web is accomplished by means of a film-welding device or an adhesive bonding device which is arranged in the vicinity of the inlet opening and produces a longitudinal seam. When a continuous tube or continuous web is used, it is advantageous to arrange a cross-welding and film-separating device in the vicinity of one of the openings, in order to ensure a clean separation of the soiled tube section before a new tube section is pulled into place. Depending on the film material being used, the separation can be accomplished for example by means of welding jaws, knives or heating wires.

If the portion of the tube section is clamped at the fastening locations by means of clamping jaws and the tube section is not designed in any special way, the clamping will reduce the passage aperture of the tube section. To prevent that the filling or pouring material which slides through the tube section when the outlet is opened could get stuck in the area of the fastening locations, the film material at least in the fastening portion of the tube section could have suitably configured fastening parts such as ears or seams protruding radially from the tube section.

As has already been mentioned above, to separate a thermoplastic film material, there can be at least one heating wire arranged between the fastening locations, with the electrical contact preferably passing through the fastening locations. Of course, the heating wire can also be imbedded in the film material, and the latter can thus include at least one heating wire arranged transverse to the lengthwise direction of the material. Instead of the heating wire, there can also be an electrically conductive film layer, a conductive filament, a conductive ribbon or any other device of this kind. The embedding of these electrical heating means in the film material can be accomplished by imprinting, laminating, adhesive bonding, vapor-depositing, spraying, melting or casting the heating means into the film material. The electrical contacting of the heating means occurs through contact locations that have been left blank, or by means of pricking, puncturing or partially removing the insulating layers of the film material that cover the heating means.

Further, instead of the heating wire there can be welding jaws incorporated in the fastening locations, or the dosage-dispensing device can have welding jaws that are operable independently of the fastening locations. Welding jaws include a heating device that serves to produce a weld seam in the film material, wherein the two welding jaws of a pair between which the film material passes are pressed against each other during the welding process.

Many dosage materials such as, in particular dry, fine powders tend to become electrostatically charged during the dosage-dispensing process. Especially with the use of plastic films, the strong build-up of electrostatic charges on the film can cause a considerable amount of the dosage material to adhere to the film. To avoid this effect, the film material can be provided with at least one conductive surface. Such surfaces can be produced by applying a metallic coating to plastic films, for example by spraying, vapor deposition, lamination, or by galvanic processes. Of course, one could also use conductive polymer films, plastic films that are made conductive by filler materials, or pure metal foils. The conductive coating of the film material that has been inserted into the dosage-dispensing device is connected to ground, a measure that is normally sufficient to prevent the build-up of an electrostatic charge. If these measures are not enough, the conductive coating can also be put under an AC voltage, preferably a high-frequency AC voltage.

As a way to minimize the risk of contamination by residues of dosage material escaping at the moment of separating the film, there can also be three heating wires or welding jaws arranged parallel to the stretch line. The heating wire in the middle has a lower electrical resistance than the two other heating wires, so as to achieve a controlled separation of the film material along the middle wire, while the two other heating wires only serve to weld shut the separated tube sections. If desired, all three heating wires can be connected simultaneously or individually to the electric power supply.

Due to the fact that the metering element is no longer in direct contact with the dosage material, the metering element no longer needs to be sealed absolutely tight. Consequently, the metering element can be designed so that it separates into two element parts along an essentially vertical plane in order to facilitate the insertion of the film material.

The disclosed embodiments further include the concept that both fastening locations can also be moved synchronously towards each other or away from each other independently of the dosage-dispensing organ. With a stretching device that is operable independently of the dosage-dispensing organ, the dosage-dispensing process can be directly influenced. There are several possible ways for the user to take advantage of this capability. First, the movement of the dosage material through the tube section can be promoted by oscillatory movements or vibrations of the fastening locations. Second, the flow passage aperture of the tube section can be varied by means of a stretching device, if the latter is arranged between the outlet opening and the container, whereby the mass flow rate of the dosage material through the metering element can be influenced. Third, by means of vibrating fastening locations, the part of the tube section below the metering element can be completely emptied and in some cases even cleaned.

The dosage-dispensing device will be described hereinafter in more detail through examples and with references to the drawing figures. In all of the drawings, there are no supporting structures illustrated such as for example racks, scaffolds, holders, platforms and the like. Also, commonly known auxiliary devices such as bearing supports or control devices and the like have intentionally been left out in order to allow a better view of the parts that are of actual relevance to the operation of the device.

BRIEF DESCRIPTION OF THE DRAWINGS

In the attached drawings, an understanding of the disclosed embodiments, where identical parts are identified with identical part numbers and where.

DETAILED DESCRIPTION OF THE PREFERRED EMBODIMENTS

Figure 1:
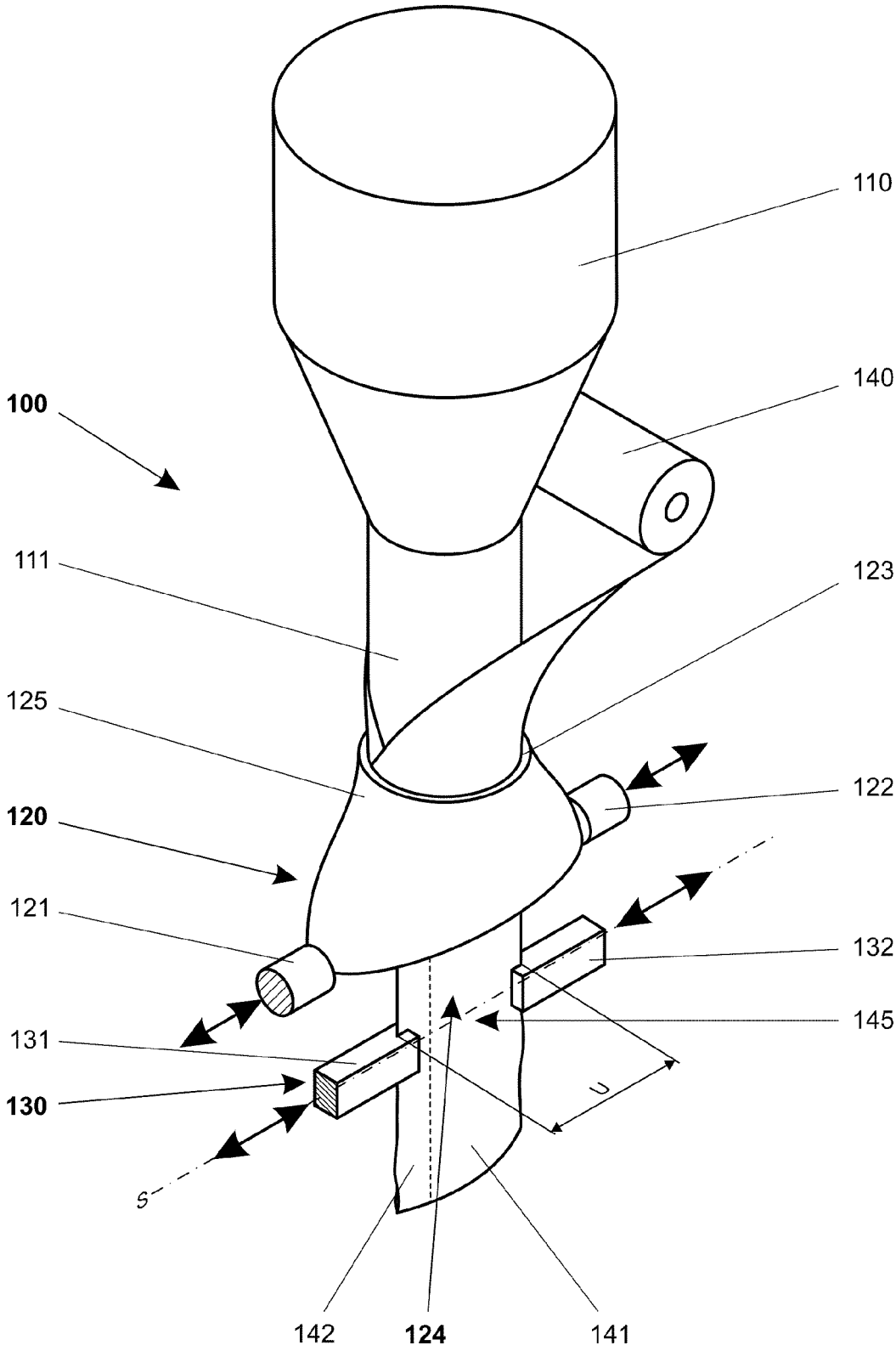
FIG. 1 is a perspective view of a dosage-dispensing device with a container, a metering element, a roll of film material whose end has been formed into a tube and pulled through the inlet opening, through the metering element, and through the outlet opening, and with a stretching device that is arranged outside of the metering element and is represented in the drawing only by two fastening locations.

FIG. 1 is a schematic three-dimensional view of a dosage-dispensing device 100 with a container 110 whose outlet spout 111 reaches into the inlet opening 123 of a metering element 120. Due to the essentially vertical arrangement of the container 110 and the metering element 120, dosage material in the container 110 can flow under its own gravity through the outlet spout 111 into the metering element 120. The latter has an outlet opening 124 which in the closed condition takes on a slot-shaped configuration. The wall 125 of the metering element 120 extends between the inlet opening 123 and the outlet opening 124. The metering element 120 is made mostly of elastic material, so that the outlet opening 124 can be opened and closed by means of a first push rod 121 and a second push rod 122. The functional concept of such a metering element 120 is accurately described in Bohler '173, which is incorporated by reference as if fully recited.

Further in the dosage-dispensing device 100, a film material 140 is being used which is configured as a film web that is wound on a roll and arranged to the side of the container 110. The film material 140 is guided through a ring gap between the outlet spout 111 and the wall 125 of the inlet opening 123 into the interior of the metering element 120, and in passing through the ring gap the web of film material 140 is formed into a tube section 141.

The end of this tube section 141 protrudes from the outlet opening 124 of the metering element 120. Arranged below the outlet opening 124 is a stretching device 130, indicated only in a schematic way by two fastening locations 131, 132. A portion 145 of the tube section 141 is clamped in the first fastening location 131 and the second fastening location 132. The orientation of the film material is selected so that the overlap 142 (indicated by a broken line) is arranged in the first fastening location 131. This is the only way in which two uninterrupted perimeter segments U of the portion 145 can be obtained which can also be put under tension. The two fastening locations 131, 132 can be moved linearly towards each other or away from each other along a stretch line S which runs parallel to the slot-shaped outlet opening 124. A target container (not shown in the drawing) into which a dose of substance is to be dispensed can be placed below the tube section 141. For target containers, receptacles of the same types can be used as mentioned previously in the description of the container 110.

Depending on the dosage-controlling algorithm, the dosage material being dispensed, or the needs of the user, the fastening locations 131, 132 can be moved either simultaneously with the push rods 121, 122 or also completely independently of their movements. In addition, the entire stretching device 130 can be configured in such a way that the two fastening locations 131, 132 are also movable in the vertical direction, so that the film material 140 can be pulled along with the help of the stretching device 130.

Figure 2:
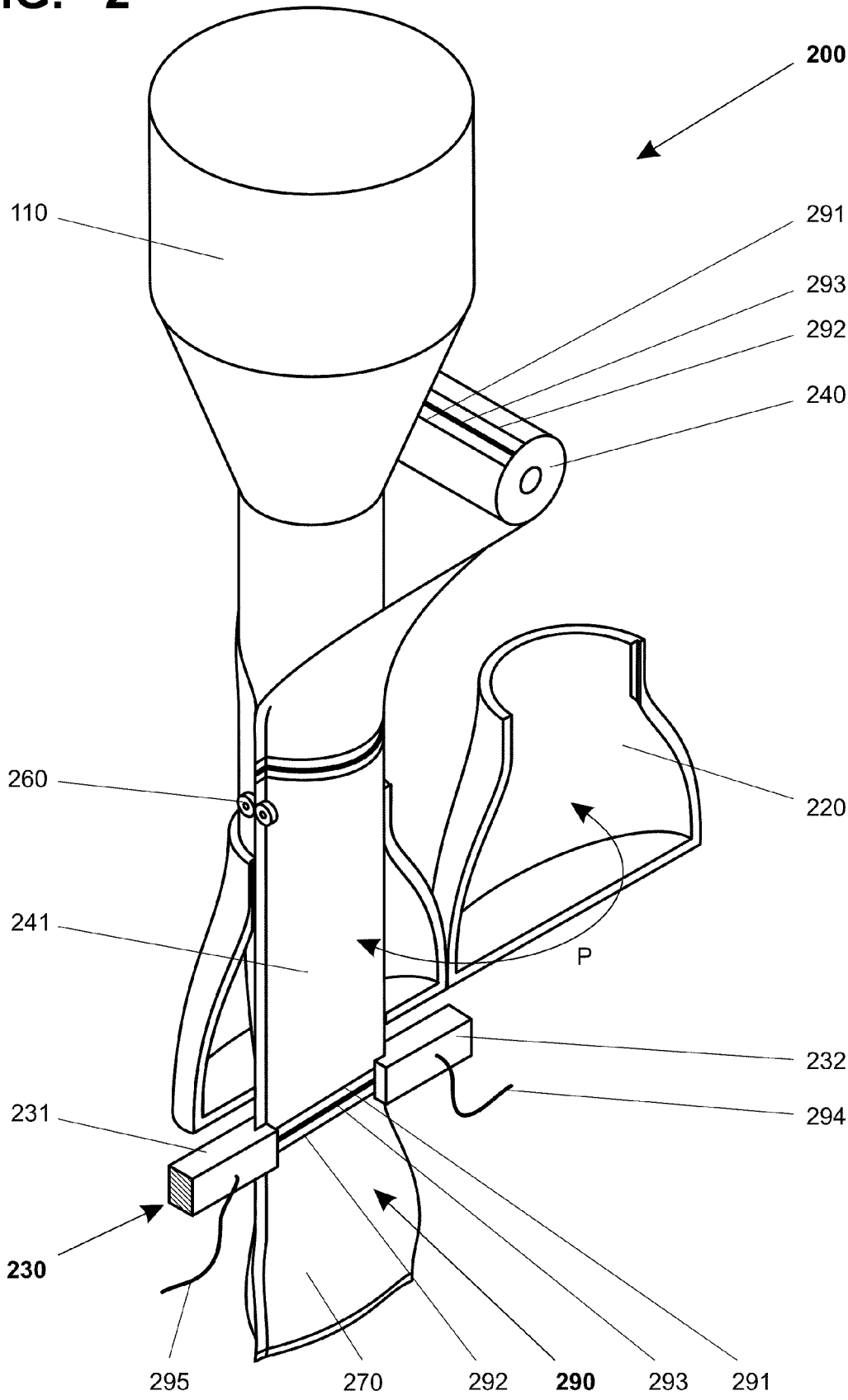
FIG. 2 is a perspective view of the FIG. 1 dosage-dispensing device, with a metering element that can be opened, with a device for welding a longitudinal seam, and with a device for welding a transverse seam.

FIG. 2 schematically illustrates a dosage-dispensing device 200 in sectional view. As the dosage-dispensing device 200 has essentially the same configuration as the FIG. 1 dosage-dispensing device 100, all of the components that are identical share the same reference symbols and are not discussed again in detail in the following description. The same also applies analogously to all of the drawing figures described hereinafter.

As a way to increase operator convenience, the dosage-dispensing device 200 presented in FIG. 2 has a metering element 220 that can be opened. The metering element 220 is shown in the open position and can be opened and closed in a simple manner, as indicated symbolically by the double arrow P. Assembly fastener elements have intentionally been omitted from the drawing, but an individual with the requisite skills may at his preference add hinges, screw fasteners or snap connectors to the metering element 220. Also shown in the drawing between the container 110 and the metering element 220 is a device 260—indicated symbolically by two rollers—for welding a lengthwise seam. With the welding device 260, a web of film material 240 which is supplied from a roll can be finished into a tube section 241 with a closed profile perpendicular to the lengthwise direction. Of course, the film material could for example also have adhesive-coated zones along its lateral borders which are pressed against each other between the rollers and thereby bonded to each other.

The arrangement further includes a device 290 for welding a transverse seam. The transverse seam welding device 290 serves to separate the tube section into two parts. A part of the transverse seam welding device 290 in FIG. 2 is incorporated in the stretching device 230, and another part in the film material 240. Each of the two fastening locations 231, 232 of the stretching device 230 has a respective connection 295, 294 to an electrical power supply, so that a heating wire 291, 292, 293 which is clamped between the two fastening locations 231, 232 can be heated up to a glowing condition. One or more heating wires 291, 292, 293 can be permanently installed between the fastening locations 231, 232 or, as shown in FIG. 2, incorporated in the film material 240 at given intervals. In the arrangement shown in FIG. 2, there are groups of three heating wires 291, 292, 293 imbedded at close distance and parallel to each other in the film material 240. The heating wires need to extend over at least half of the width of the film material 240. The two outer, thin heating wires 291, 292 serve to produce a tear-resistant seam, so that at the given intervals the tube section 241 can be tightly sealed by seams that run perpendicular to the lengthwise direction of the film material. The median heating wire 293 has a lower electrical resistance, as indicated symbolically by the larger line width, and thus a stronger heating power than the outer heating wires 291, 292. The median heating wire 293 serves to cut the tube section 241. Of course, the heating wires 291, 292, 293 can also be connected to individual contacts, so that they can be supplied with current separately and/or for different respective time intervals. If the panels of the film material 240 are not in sufficiently firm contact with each other to ensure a reliable weld, there can be clamps arranged laterally (not shown in the drawing) in such a way that opposing clamp jaws between which the film material 240 is passed are pressed against each other during the welding process. As a further possibility, a dosage-dispensing device 200 equipped in this manner can also be used to produce target containers 270 out of the film material 240, i.e. individual pouches that are filled with dosage material and welded shut.

Of course, instead of the heating wires 291, 292, 293, there can be welding jaws (not shown in the drawings) incorporated in the fastening locations 231, 232, or the dosage-dispensing device 200 can have welding jaws which are operable independently of the fastening locations 231, 232. Welding jaws include a heating device for producing a weld seam in the film material 240, wherein the two halves of the jaw welder between which the film material 240 passes are pressed against each other during the welding process.

Figure 3:
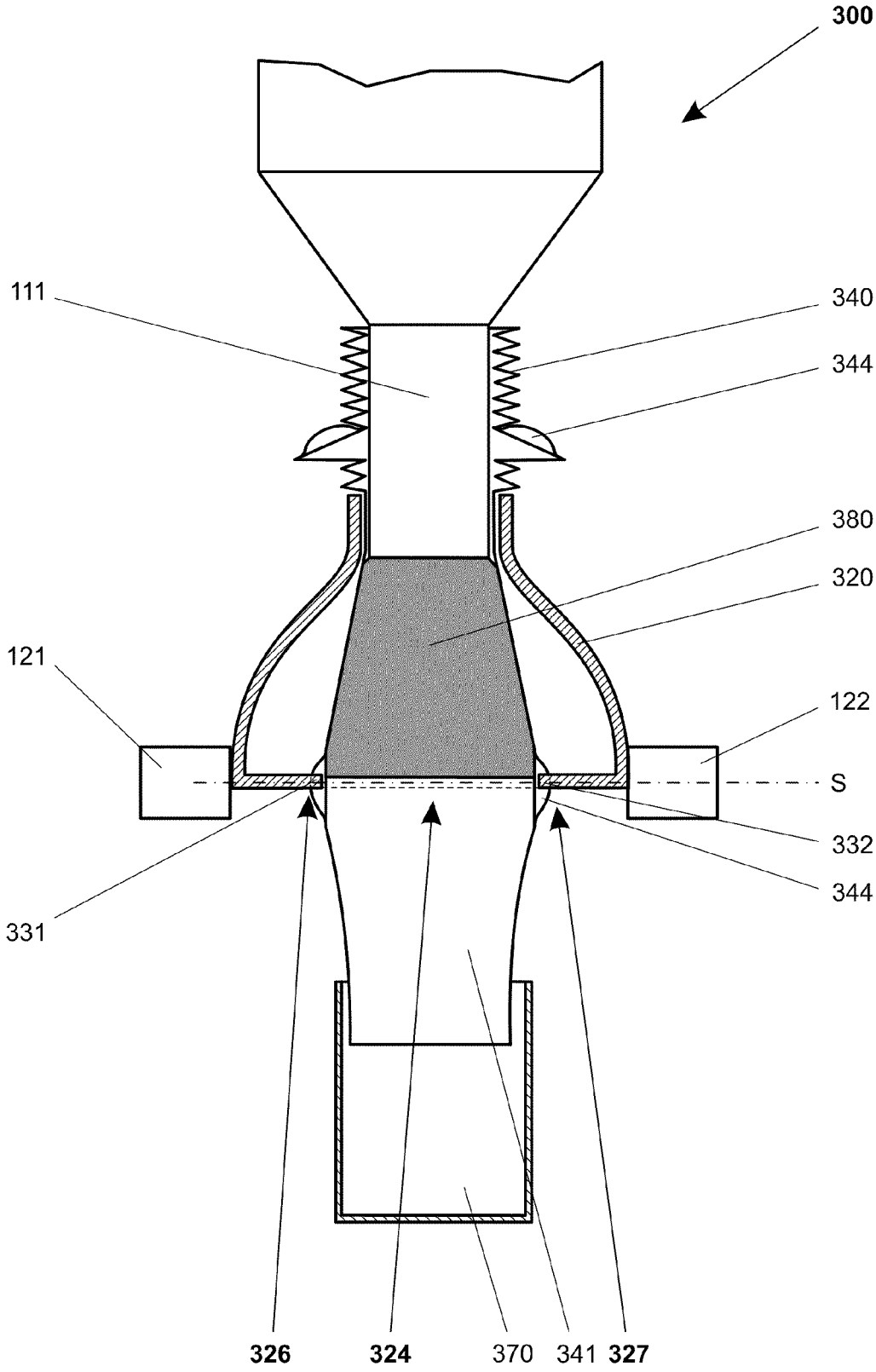
FIG. 3 is a side sectional view of a dosage-dispensing device with its outlet opening closed, with a container, a metering element, and with a film material configured as a tube, a supply of which is kept in the vicinity of the container and which is pulled through the metering element and the outlet opening, as well as with a stretching device which is incorporated in the slot-shaped outlet opening.

In contrast to the dosage-dispensing device 100 of FIG. 1, the dosage-dispensing device 300 in FIG. 3 uses a film material 340 which is closed around its cross-sectional perimeter, i.e. configured as a tube, a supply of which is stored in the area of the outlet spout 111. As a further feature, the film material 340 has pairs of radially protruding ears 344 placed at certain intervals. As a result of these ears 344 which serve to fasten the film material at the fastening locations 331, 332 of the stretching device, no constriction of the aperture cross section of the tube section 341 is caused by clamping the ears in the fastening locations 331, 332. The end of the tube section 341 reaches into a target container 370. The ears 344 can also be designed to be elastic, so that the film material 340 is being pre-stretched when the metering element 320 is closed.

The metering element 320 which adjoins the outlet spout 111 functions simultaneously as the stretching device. This means that the first fastening location 331 is arranged at the first end 326 of the slot-shaped outlet opening 324 and the second fastening location 332 is arranged at the second end 327 of the slot-shaped outlet opening 324. The latter is shown in the closed state, and the dosage material 380 (indicated by gray shading) coming from the container 110 and flowing through the outlet spout 111 into the tube-shaped film 340 can therefore only get as far as the closed outlet opening 324 where it is held back.

As soon as the outlet opening 324 is opened by means of the two push rods 121, 122, the traction is also released on the film material 340 which is under tension along the stretch line and, dependent on the displacement of the push rods 121, 122 towards each other, a corresponding passage aperture is set free.

Figure 4:
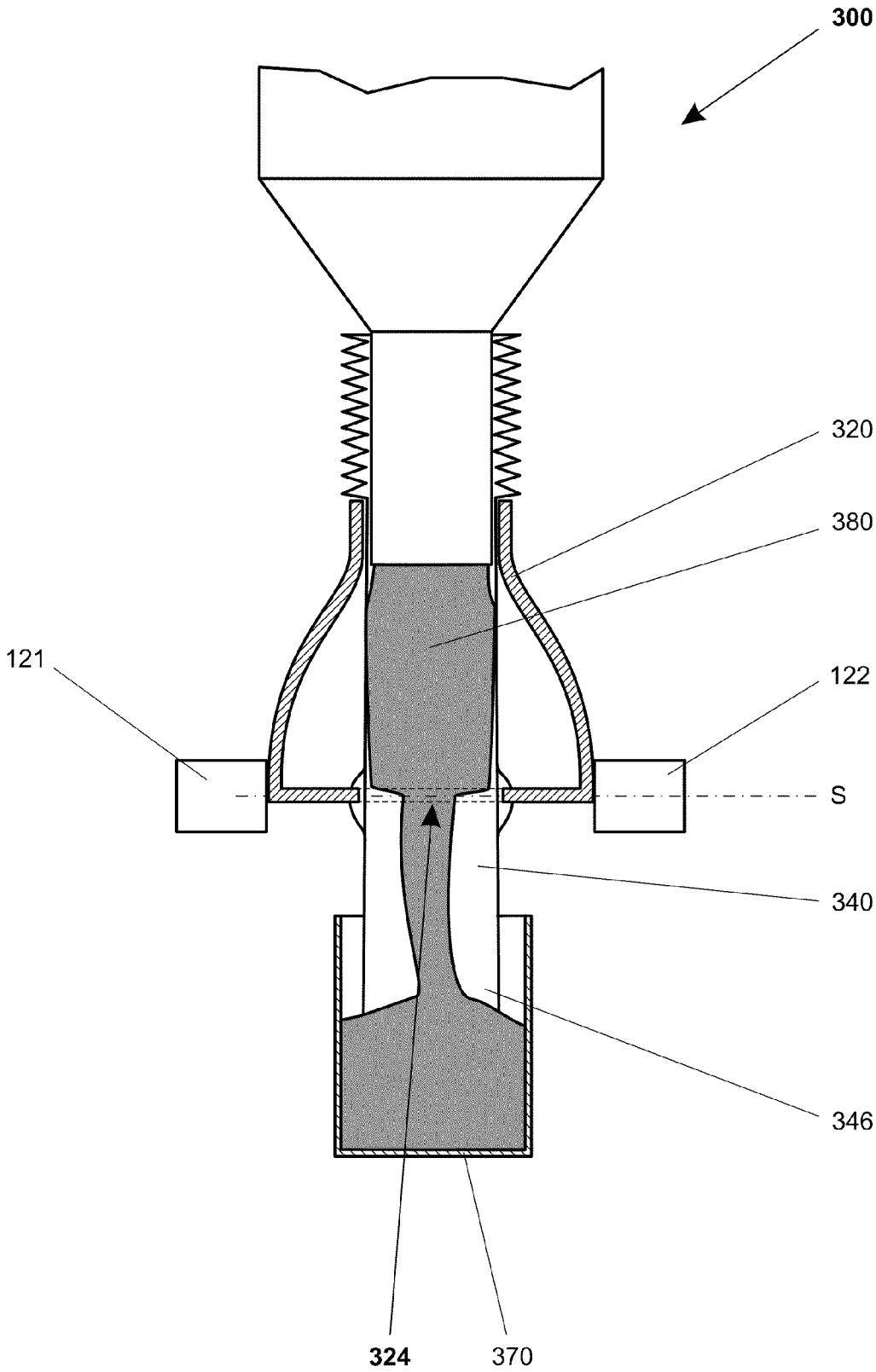
FIG. 4 is a side sectional view of the FIG. 3 dosage-dispensing device, but with the outlet opening in an opened condition.

Exactly this condition is illustrated in FIG. 4. Based on the outflow of dosage material 380 it is evident that the outlet opening 324 of the dosage-dispensing device 300 is only partially opened. The dosage material 380 flows into a target container 370 set below the tube end 346 until the push rods 121, 122, through a linear movement away from each other, release the compressive force on the metering element 320 which is made of an elastic material, whereby the outlet opening 324 is closed and at the same time the film material 340 is set under tension along the stretch line S.

Figure 5A:
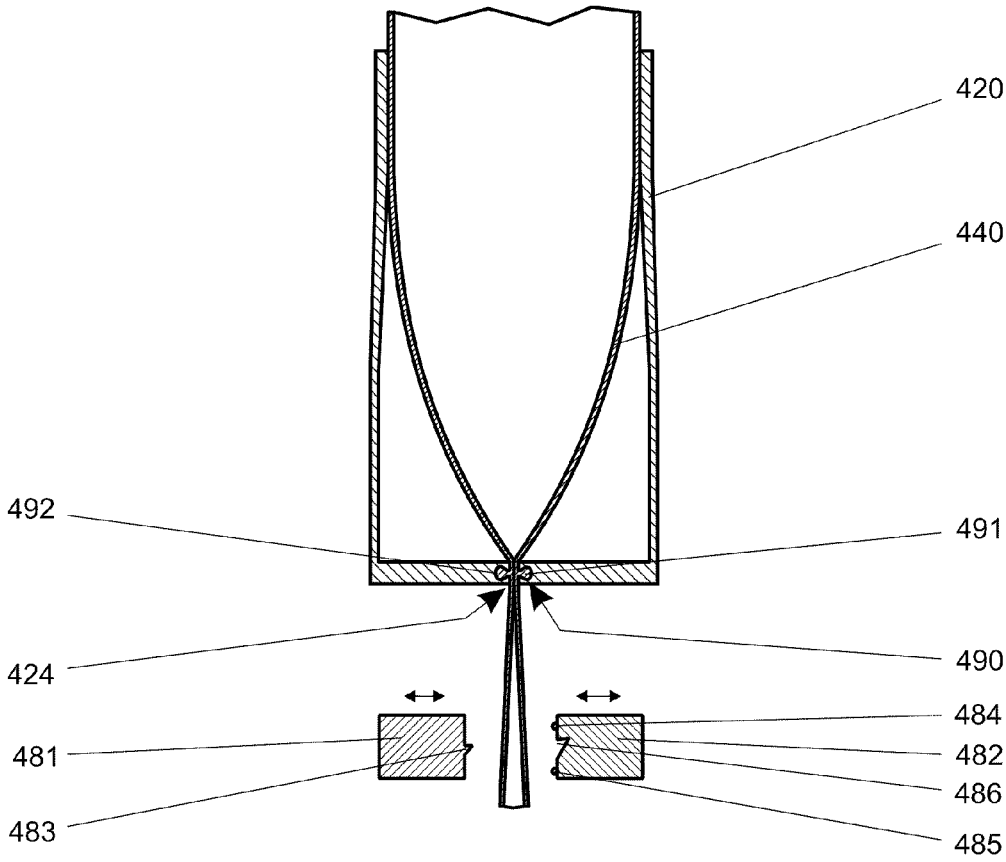
FIG. 5A is a side sectional view of the same metering element as shown in FIGS. 3 and 4, wherein a perimetric fastening means is arranged around the outlet opening, the latter being shown in the closed state.

FIG. 5A shows in a sectional view essentially the same metering element as illustrated in FIGS. 3 and 4, except for one minor modification which, however, leads to excellent results. In this metering element 420, the film material 440 is likewise fastened in the slot-shaped outlet opening 424 but, rather than being held at only two fastening locations, the film material 440 is secured around its entire perimeter by continuous fastening means 490. Such continuous perimeter fastening means 490 can consist, as illustrated, of a radially protruding rib 491 formed on the film material 440 around a closed outside perimeter, and a perimetric groove 492 formed in the outlet opening 424 and conforming to the rib 491. The perimetric rib 491 and the perimetric groove 492 are configured in such a way that the rib 491 can be snap-fitted into the groove 492 and also released again by applying a certain degree of force. Of course, other perimetric fastener means are also conceivable, such as hook- and loop fasteners or adhesive pads.

Arranged below the outlet opening 424 are welding jaws 481, 482. The first welding jaw 481 serves essentially as a counter hold and includes a knife 483. The second welding jaw 482 includes two heating wires 484, 485 and a cutter edge 486. To cut the film material 440 and close the resulting sections with weld seams, the two welding jaws 481, 482 are pushed together, and the welding and cutting are performed in one step.

Figure 5B:
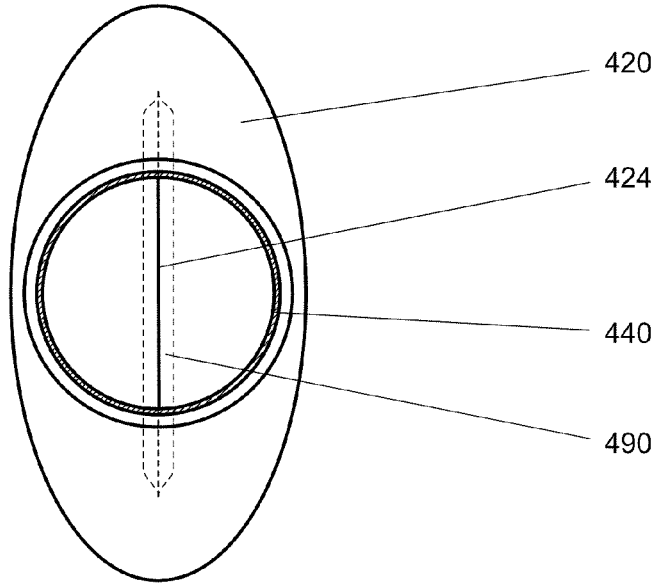
FIG. 5B is a top plan view of the FIG. 5A metering element.

FIG. 5B shows a plan view of the metering element 420 of FIG. 5A and the film material 440. The slot-shaped outlet opening 424 in closed condition and the perimetric fastening means 490 represented by a broken line are clearly identifiable.

Figure 6:
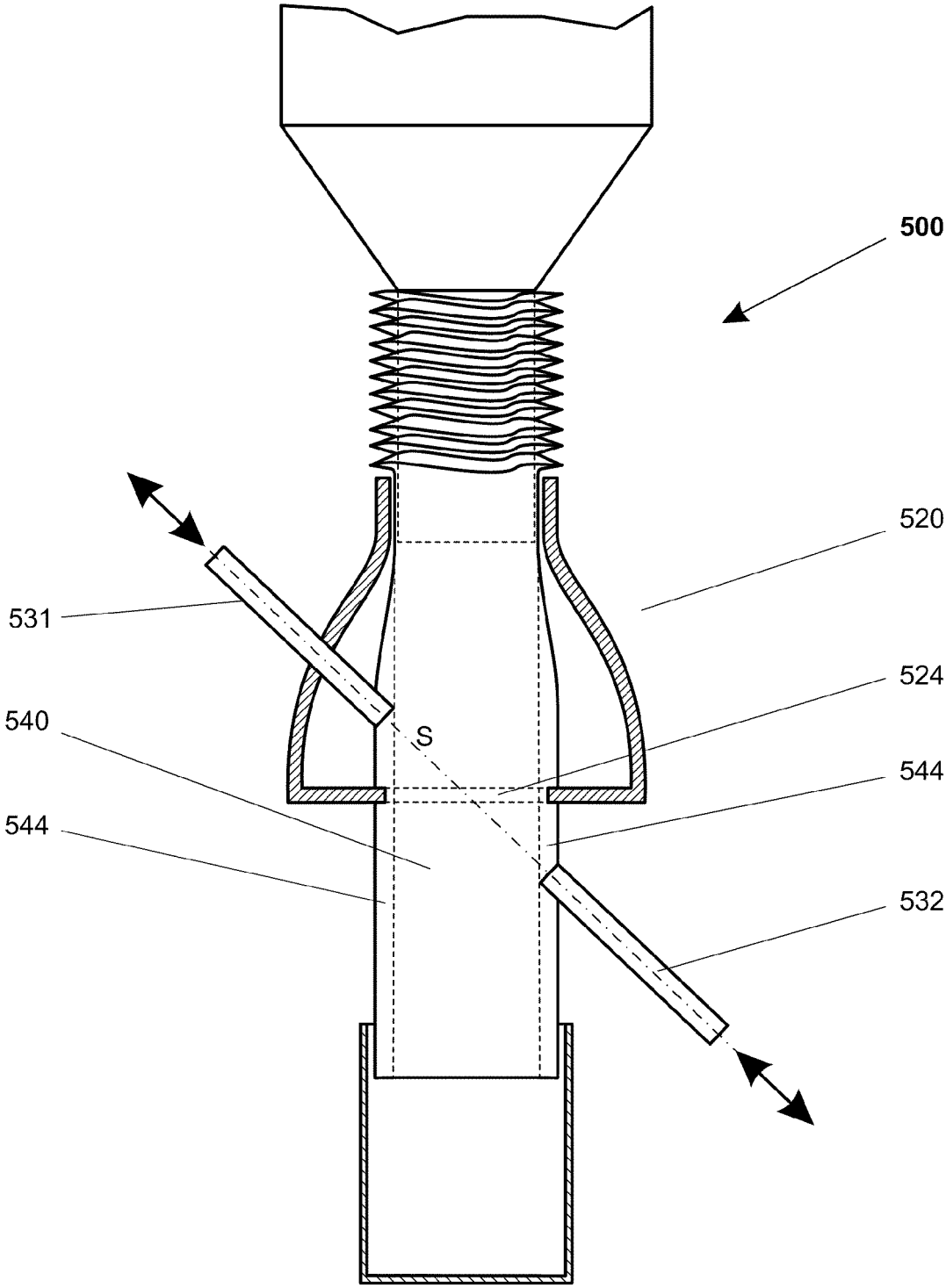
FIG. 6 is a side sectional view of the dosage-dispensing device as shown in FIGS. 3 and 4, wherein the stretch line is arranged at an angle to the slot-shaped outlet opening.

FIG. 6 shows in essence the same dosage-dispensing device as illustrated in FIGS. 3 and 4. However, unlike the device of FIGS. 3 and 4, the dosage-dispensing device 500 in FIG. 6 has a stretch axis S oriented at an oblique angle to the slot-shaped outlet opening 524. The first fastening location 531 is arranged inside the metering element 520, and the second fastening location is arranged outside the metering element 520. Consequently, the stretch axis S and the slot-shaped outlet opening 524 in its closed condition intersect each other. Instead of ears, the tube of film material 540 has two seams 544 extending in the lengthwise direction.

Figure 7:
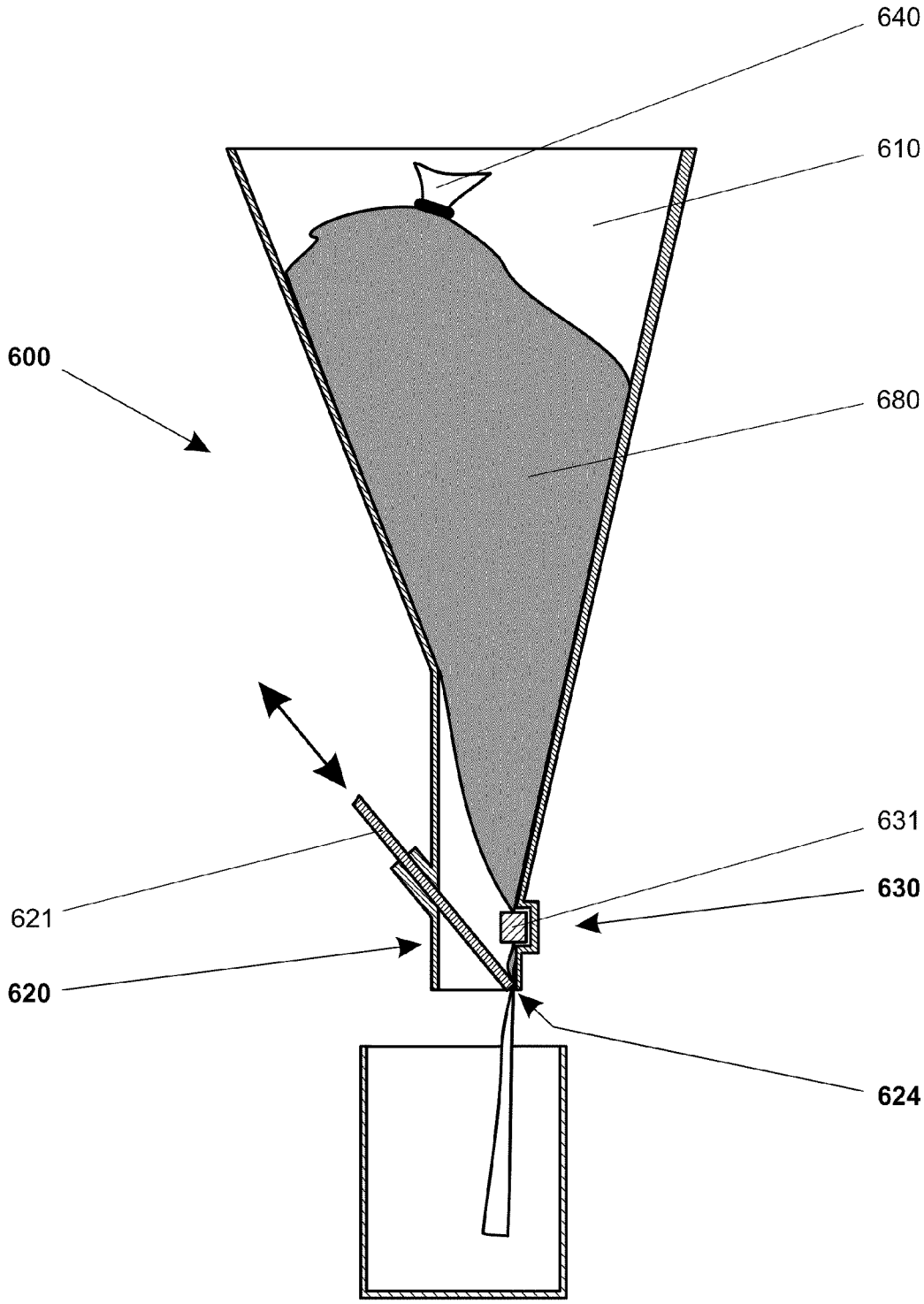
FIG. 7 is a side sectional view of a dosage-dispensing device with its outlet opening closed, with a funnel-shaped container, a slide shutter as metering element, and a film material configured as a tube which is arranged inside the container and contains the dosage material, wherein one end which forms the fill opening of the film tube is tied shut and the other end is pulled through the metering element and its outlet opening, and wherein the stretching device is arranged inside the metering element.

FIG. 7 represents a schematic sectional view of a dosage-dispensing device 600 with a funnel-shaped container 610 and a metering element 620. Instead of an elastic metering element, the metering element 620 in FIG. 7 has a slide shutter 621 which together with a flat side wall of the metering element 620 forms an outlet opening 624 which is slot-shaped in its closed state. Of course, instead of the flat side wall, the arrangement can also include a second slide shutter that is movable in relation to the slide shutter 621. Arranged inside the container 610 is a bag formed of a tube of film material 640 which contains the dosage material 680. The one end which forms the inlet opening of the tube of film material 640 is tied shut, while the other end is pulled through the metering element 620 and its outlet opening 624. A stretching device 630 of which only the first fastening location 631 is visible is arranged between the container 610 and the outlet opening 624. The stretch line of the stretching device 630 as well as the slot-shaped outlet opening 624 are oriented at a right angle to the drawing plane of FIG. 7. There is no difference in design and function of this stretching device 630 compared to the previously described embodiments.

Instead of a container 610 that is lined with film material 640, the bag itself can serve as container, suspended from a suitable hanger device (not shown in the drawing), with one end of the bag pulled through the metering element 624 as shown in FIG. 7. This bag can also have several ends, comparable to the fingers of a rubber glove, wherein the different fingers can be pulled through the metering element one after another as needed. An embodiment of a suitable dosage-dispensing device 600 with the multi-ended bag of the foregoing description is also conceivable which has several metering elements 624 arranged parallel to each other, wherein a different end of the bag passes through each metering element 624.

While the invention has been presented through a description of specific examples of embodiments, it is considered evident that numerous further variants can be created based on a knowledge of the present invention, for example if features such as the welding devices which were shown herein for specific embodiments are used in other embodiments, and/or if a specific functional unit of an embodiment, such as tube-shaped film material, is exchanged for material in the form of a web. It is further possible to connect a plurality of metering elements, each with its own stretching device, to a container. In particular, one could conceive of further arrangements in which the subject of this invention may be incorporated, for example if the dosage-dispensing device in an automated version is used as a component of a larger apparatus.

What is claimed is:

1. A device for dispensing a material in dosages, comprising:

a container for the dosage material;

an outlet spout of the container;

a metering element, adjoining the outlet spout, the metering element comprising:

an inlet opening on a side that faces towards the container;

an outlet opening on a side that faces away from the container, the outlet opening being slot-shaped when in a closed condition; and a wall with an inside and an outside, extending between the inlet and outlet openings;

a film material which is inserted into the metering element to reach at least through the inlet opening and the outlet opening while covering the inside of the wall, the inserted film material formed into a tube section from at least the inlet opening through the outlet opening, the tube section extending into a space below the outlet opening; and a stretching device that stretches a cross-sectional perimeter of a portion of the tube section, the cross-sectional perimeter defined by a plane arranged at an angle to a lengthwise direction of the tube section, the stretching device comprising:

a first location for fastening the portion of the tube section; and a second location for fastening the portion of the tube section, the respective fastening locations positioned on the stretch line, with at least one of the fastening locations being linearly displaceable along the stretch line, the fastening locations dividing the cross-sectional perimeter into two perimeter segments of essentially equal length.

2. The dosage-dispensing device of claim 1, wherein:

the stretch line is located in a plane that contains the outlet opening and which extends in the lengthwise direction of the tube section.

3. The dosage-dispensing device of claim 1, wherein:

the stretch line is oriented parallel to the outlet opening, with the distance between the stretch line and the outlet opening being less than or equal to a predetermined maximum that is defined by the material properties of the film material.

4. The dosage-dispensing device of claim 1, wherein:

at least one of the fastening locations is arranged inside the metering element.

5. The dosage-dispensing device of claim 1, wherein:

the stretch line extends within the outlet opening, with the first fastening location arranged in the vicinity of a first end of the outlet opening and the second fastening location arranged in the vicinity of a second end of the outlet opening.

6. The dosage-dispensing device of claim 1, wherein:

the metering element comprises an elastic material in which the outlet opening is formed.

7. The dosage-dispensing device of claim 6, wherein:

the fastening locations are fixedly connected to the respective ends of the outlet opening of the metering element, such that the closing of the outlet opening moves the fastening locations apart, stretching the tube section.

8. The dosage-dispensing device of claim 6, further comprising:

perimetric fastening means in the area of the outlet opening of the metering element, serving to fasten the entire perimeter of the tube section.

9. The dosage-dispensing device of claim 1, wherein:

the metering element further comprises at least one slide shutter or at least one shutter jaw.

10. The dosage-dispensing device of claim 1, wherein:

the film material, at least in the stretched portion, comprises fastening parts such as ears or seams which protrude radially from the tube section and are suitably configured for connection to the fastening locations.

11. The dosage-dispensing device of claim 10, wherein:

the film material, in cross-section, has a closed-perimeter tube profile.

12. The dosage-dispensing device of claim 1, further comprising:

a heating wire, arranged between the fastening locations, which can be electrically contacted therethrough.

13. The dosage-dispensing device of claim 12, wherein:

three heating wires are arranged parallel to the stretch line, with the median wire of the three wires having a lower electrical resistance than the outer wires, for effecting a controlled separation of the film material along the median heating wire.

14. The dosage-dispensing device of claim 1, further comprising:

at least two welding jaws.

15. The dosage-dispensing device of claim 1, further comprising:

a substantially vertical separation plane of the metering element, along which the film material is inserted.

16. The dosage-dispensing device of claim 1, wherein:

the fastening locations can be moved synchronously towards each other or away from each other.

17. The dosage-dispensing device of claim 1, further comprising:

at least one electrically conductive surface on the film material.

18. A film material for use in a dosage-dispensing device of claim 1, comprising:

a web of thermoplastic polymer, suitable to form a tube section; and a plurality of sets of one or more electrically conductive elements, each set spaced at a regular interval along a longitudinal direction of the web, with each conductive element arranged across the web transverse to the longitudinal direction.

* * * * *